US007275273B2

(12) United States Patent
Lary et al.

(10) Patent No.: US 7,275,273 B2
(45) Date of Patent: Oct. 2, 2007

(54) EXPANDABLE ELEVATING BOLSTER

(76) Inventors: Banning Gray Lary, 6371 SW. 87th Ter., Miami, FL (US) 33143; Aniceto Esteban Fernandez, 1197 SW. 133 Pl., Miami, FL (US) 33184

( * ) Notice: Subject to any disclaimer, the term of this patent is extended or adjusted under 35 U.S.C. 154(b) by 0 days.

(21) Appl. No.: 11/067,363

(22) Filed: Feb. 25, 2005

(65) Prior Publication Data

US 2005/0251918 A1 Nov. 17, 2005

Related U.S. Application Data

(63) Continuation-in-part of application No. 10/614,522, filed on Jul. 1, 2003, now abandoned.

(60) Provisional application No. 60/410,248, filed on Sep. 12, 2002.

(51) Int. Cl.
*A61G 15/00* (2006.01)
*A61G 13/12* (2006.01)

(52) U.S. Cl. ..... 5/634; 5/648; 297/377

(58) Field of Classification Search ..... 5/634, 5/648, 635, 633, 632, 630, 646, 650; 297/377
See application file for complete search history.

(56) References Cited

U.S. PATENT DOCUMENTS

| | | | | |
|---|---|---|---|---|
| 241,748 A | | 5/1881 | Strauss | |
| 319,537 A | * | 6/1885 | Winter | 5/634 |
| 1,103,730 A | * | 7/1914 | Anderson | 5/634 |
| 1,842,424 A | | 1/1932 | Ponten et al. | |
| 2,250,026 A | * | 7/1941 | Laukhuff | 5/634 |
| 2,663,029 A | * | 12/1953 | Whitley et al. | 5/634 |
| 2,666,216 A | * | 1/1954 | Schnaitter | 5/660 |
| 3,276,817 A | * | 10/1966 | Marple | 297/377 |
| 3,329,979 A | * | 7/1967 | Arnold | 5/634 |
| 3,800,338 A | * | 4/1974 | Smith | 5/617 |
| 3,822,424 A | | 7/1974 | Messer | |
| 4,432,108 A | | 2/1984 | Chapman | |
| 4,558,692 A | | 12/1985 | Greiner | |
| 6,029,669 A | | 2/2000 | Hammock | |
| 2002/0108178 A1 | * | 8/2002 | Francois | 5/648 |

* cited by examiner

*Primary Examiner*—Alexander Grosz
(74) *Attorney, Agent, or Firm*—McHale & Slavin PA

(57) ABSTRACT

A medical bolster for alleviating the effects of poor circulation supports either the legs above the heart or the heart above the extremities to improve blood and lymph fluid flow in a patient. The collapsible bolster has an articulated frame pivotally connected together for adjusting the angle between the base frame member and the support frame member. A brace extends between the base frame and the support frame to fix and secure the frame in a selected position. The brace has a safety stop to prevent injury during collapse and the brace is oriented to vector the forces within the articulated frame.

9 Claims, 4 Drawing Sheets

EXPANDABLE ELEVATING BOLSTER

RELATED APPLICATIONS

This application is a continuation in part of U.S. patent application Ser. No. 10/614,522, filed Jul. 1, 2003, now abandoned which claims priority based upon U.S. Provisional Application 60/410,248, filed Sep. 12, 2002, the contents of which are herein incorporated by reference.

BACKGROUND OF THE INVENTION

1. Field of the Invention

This invention relates generally to devices to aid in blood circulation and more particularly to a bolster to support and elevate a portion of a person's body.

2. Background Information

When there is obstruction from proximal pressure or some other impeding condition, the return of blood and lymph fluid proximal to the heart and chest results in pain, swelling, ulceration, pigmentation, and other maladies of the lower extremities. Injuries such as fractures, lacerations, contusions, for example, that are accompanied with tissue swelling similarly decrease the natural return of blood and lymph. Such conditions may result in longer healing processes. When blood pools in the deep venous system thrombophlebitis and lymph edema can occur from simple external pressure to the calf or a prolonged dependent position.

External compression dressings help to overcome these problems, but the most effective method is simply to elevate the lower extremity above the level of the heart. In such a position gravity accompanied by the muscular contraction and the negative venous pressure supplied by the normal cardiac contractions will rapidly resolve the peripheral edema in most instances. Following childbirth and certain operative procedures, in order to prevent both superficial and deep phlebitis, the legs are elevated. Many methods of doing this are ineffective or dangerous. Such is found when pillows are placed beneath the calves. Other methods include elevating the foot and the head of special hospital type beds. This results in pooling blood in the pelvis and setting the stage for pelvic phlebitis. Still other methods to elevate the bed require placing a chair or some sort of jack under the foot of the bed. This is cumbersome and the angle of elevation is severely limited.

U.S. Pat. No. 6,029,669 to Hammock discloses a selectively positionable back rest for supporting a person during an diagnostic examination that requires swallowing a barium contrast medium. The board has a seat portion and a pivotable back portion connected by a hinge allowing the back to be placed at an angle to the seat. A U-shaped bar is attached at its open end to the back by hinges and a series of stops are located on the base which extends from the seat portion. This allows the angle of the back portion to be adjusted and held in position.

Messer, U.S. Pat. No. 3,822,424, and Ponten et al, U.S. Pat. No. 1,842,424, both disclose portable chairs with a flat seat portion and an adjustable back rest.

U.S. Pat. No. 4,432,108 to Chapman discloses a leg support as a A-shape support for placing below the knee to elevate the knee.

Greiner, U.S. Pat. No. 4,558,692, discloses a powered exerciser for the leg that raises the lower leg to a position that places the thigh in a vertical orientation with regard to the body.

What is needed in the art is a simple apparatus that may be placed under the patient in either of two operative positions to alleviate the conditions resulting from poor blood circulation in supine or prone patients.

SUMMARY OF THE INVENTION

Therefore, an objective of this invention is to provide an apparatus that elevates the extremities above the level of the heart in one position and, in the reverse position, the heart is elevated above the extremities.

Another objective of this invention is to provide a lightweight articulated frame having a base and a back capable of supporting a patient and assuming different angular positions with respect to each other.

A further objective of this invention is to provide a collapsible frame which directs support forces toward the patient.

Yet another objective of this invention is to provide a safety stop for the collapsible frame to prevent injury to the operator during adjustment of the frame.

A still further objective of this invention is to provide a covering for the frame that has a high coefficient of friction in order to prevent the apparatus from changing position.

Another secondary and important function of the apparatus is to permit the head, neck and chest to be elevated above the legs of a bedridden patient to prevent acid and bile regurgitation from the stomach into the esophagus.

Also, it has been demonstrated that patients can sleep with the head and chest elevated resulting in reduction or elimination of medication. Other activities, such as reading or watching television are more comfortable for the patient, as well as, ingestion of food and fluids.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION

Figure 1:
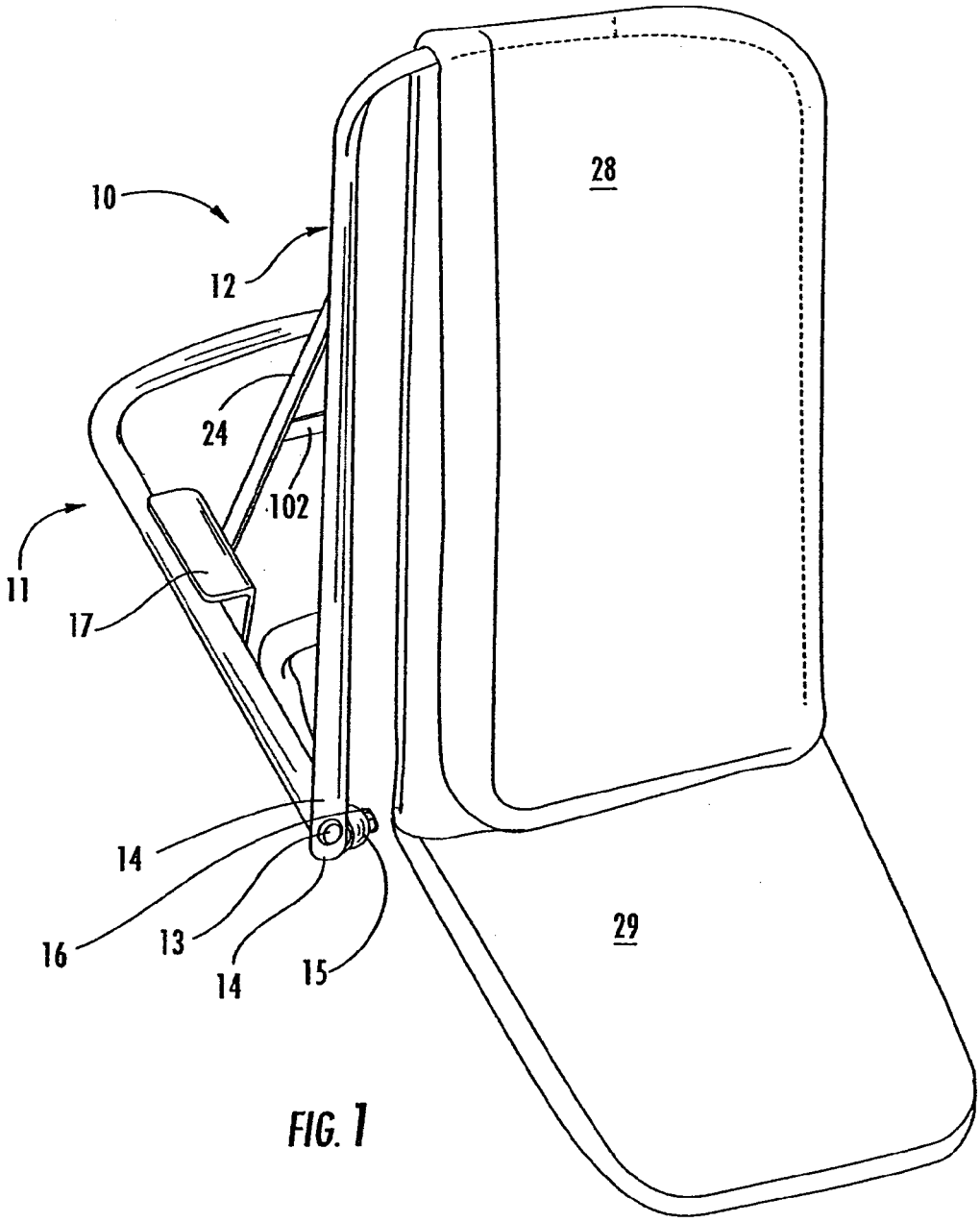
FIG. 1 is a perspective view of the apparatus of this invention.
Figure 2:
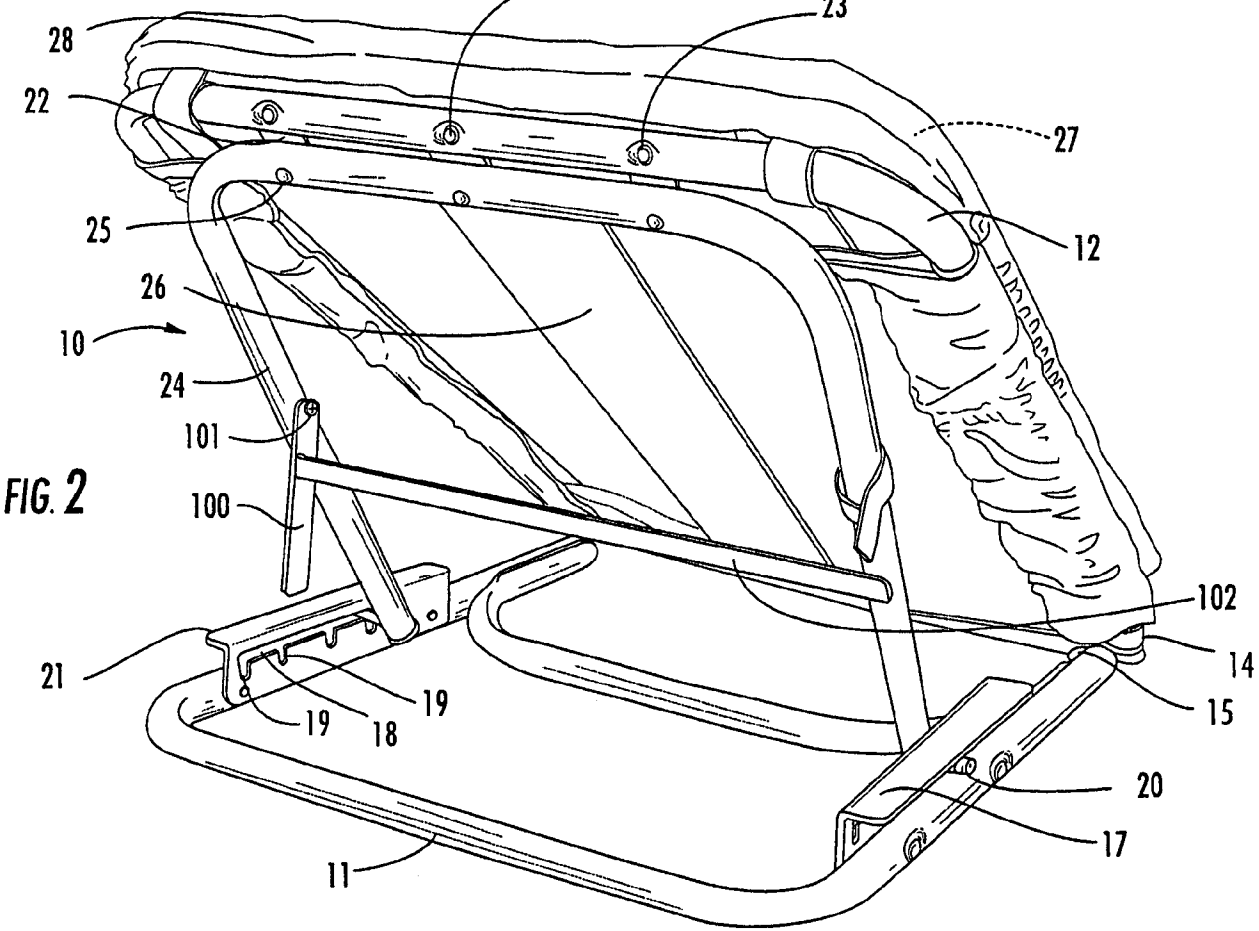
FIG. 2 is an end view of the apparatus of FIG. 1.
Figure 3:
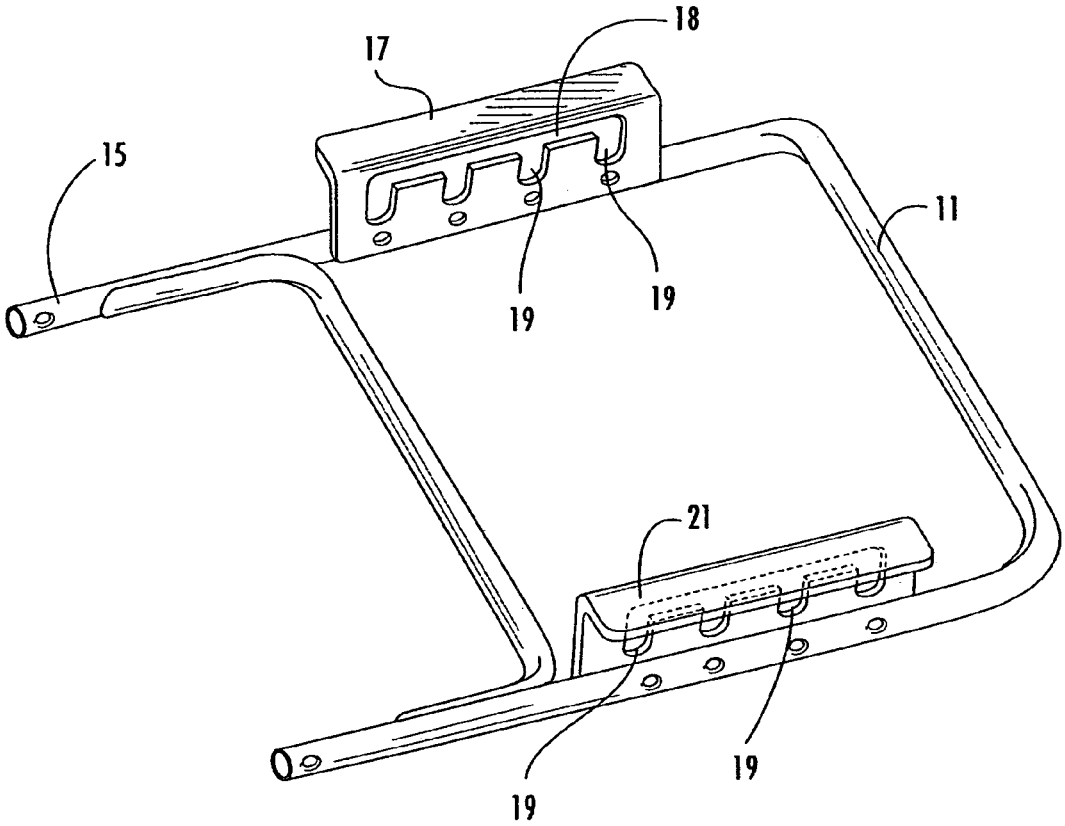
FIG. 3 is a plan view of the base frame of this invention.

The bolster 10, shown in FIG. 1, has a base frame 11 and a support frame 12. The base frame 11 is placed on a bed or table or other surface that will support a patient. The base frame 11 and the support frame 12 are both shown, in FIG. 2, as U-shaped tubular metal members joined at the open ends of each U-shaped member. The bolt 13 connecting the end 14 of support frame 12 and the end 15 of the base frame 11 passes through both members and is fastened by a nut 16. The other ends of the base frame and the support frame are similarly fastened together. The connection permits the base frame and the support frame to rotate about the bolts. Other configurations of the base frame and support frame are possible, for example, a box frame or solid sheet. Other materials may also be used for the frame members, such as, wood, solid metal rods, or polymeric materials of sufficient strength.

A ratchet fastener 17 is permanently attached to base frame 11 between the bottom of the U-shaped form and the end 15 of the member. An identical ratchet fastener 21 is permanently attached to the opposite member. The fastener 21 has a longitudinal slot 18 with a series of longitudinally spaced detents 19 for cooperation with a sliding pawl 20.

The U-shaped form of support frame 12 is longer than the dimensions of the U-shaped form of the base frame 11. The support frame 12 has a hinge 22 with one element secured along the U-shaped portion of the member by fasteners 23 which may be in the form of screws, bolts, rivets, welding or other bonding. The other hinge element is connected to brace 24 by fasteners 25 similar to fasteners 23. Because of the differing lengths of the base frame and the support frame, the hinge is located beyond the dimensions of the base frame. The brace 24 is also a U-shaped component made of similar materials to the other frame members. The open ends of the U-shaped brace 24 each have a pawl 20 attached thereto.

The pawls 20 slide in the longitudinal slots of fasteners 17 and 21 and engage any one of the detents to adjust and temporarily secure the height of the support frame above the base frame. When the pawls are in their respective detents, the brace 24 vectors the forces derived from the weight of the patient toward the ends 14 and 15 of the frame members and the center of mass of the patient. This orientation results in the bolster 10 remaining in place, relative to the patient, during use.

Figure 4:
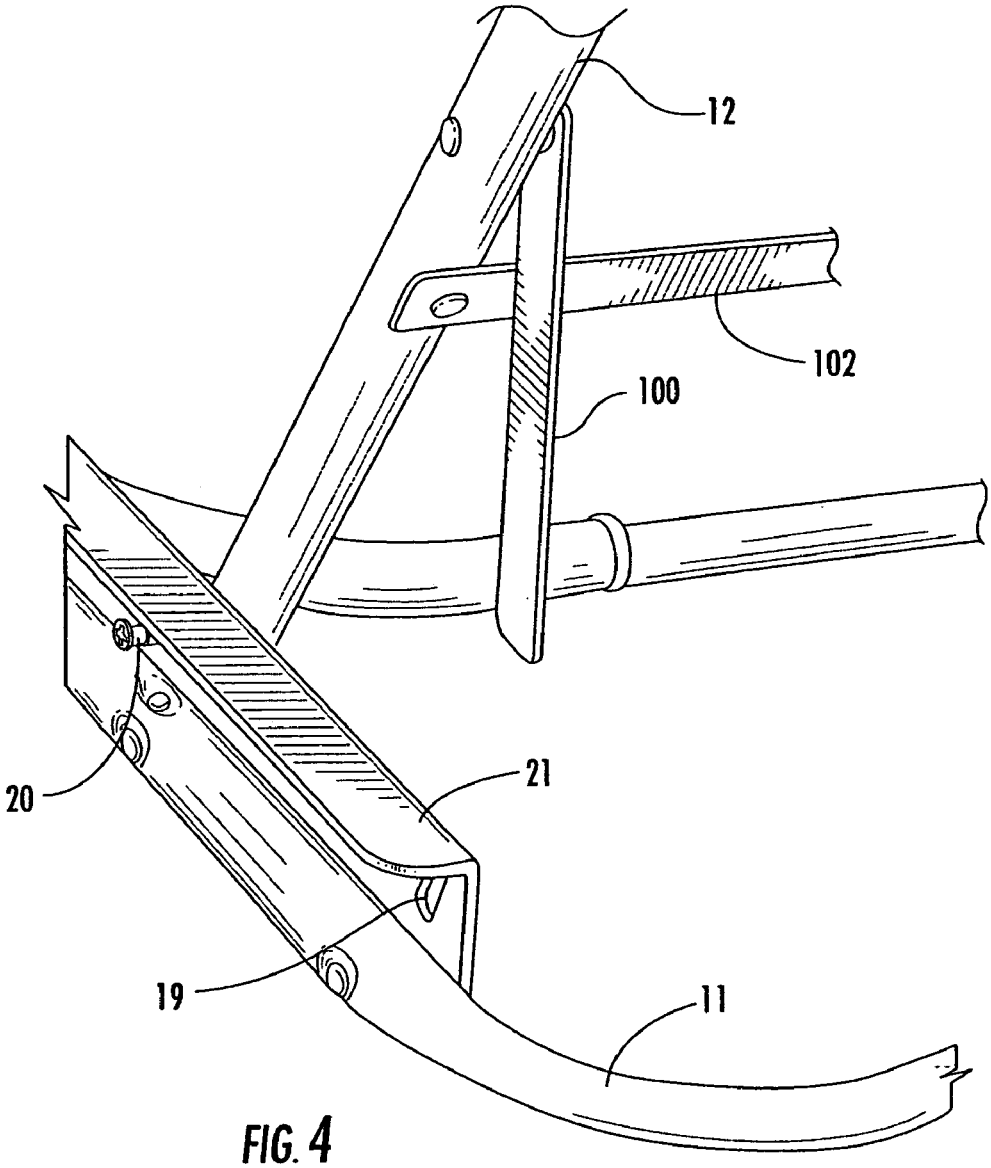
FIG. 4 is a perspective of the safety stop of this invention.

During use, the support frame carries a considerable load. In some cases, the angle of the bolster needs to be changed without the patient being moved. The attendant must lift the pawls out of the detents which transfers the patient's weight to the support frame. If the attendant cannot lift the weight, the bolster may collapse prematurely causing injury to the hands of the attendant as the frame members come in contact with each other. A safety stop 100, shown in FIG. 4, is mounted on the brace 24 by a rotating connector 101 which allows the safety stop to be stowed in the storage position. A horizontal bar 102 extends across the U-shaped brace 24 to limit rotation of the safety stop 100. Therefore, if control of the support frame is lost, the safety stop 100 prevents the support frame 12 and the base frame 11 from coming in contact with each other.

The relative widths of the base frame and the support frame may vary. For example, if the bolster is made to support one leg, the support frame may be narrower than the base frame. If the bolster is to be used for both the legs and, in the reverse position, the back of a patient, the support frame is wider than the base frame. In the storage position, the pawls are slid to the end of the longitudinal slots placing the brace, the base frame and the support frame approximately parallel and in contact with each other.

The bolster 10 provides comfort when elevation of the head and torso or the legs is preferable to the supine state. Between the U-shaped support frame members a sturdy material 26 is attached. A soft pad 27 with elevations along the sides is placed on the surface of the material 26. The pad 27 has a covering 28 with an extension 29 continuing past the rotatable connection of the base frame and the support frame and disposed under the patient in order for the body weight to keep the bolster 10 from moving.

The material of the extension 29 has a high coefficient of friction, such as rubberized fabric, to increase the attraction between the extension and the surface supporting the patient.

As mentioned above, the bolster 10 may be used in two reversed positions depending on whether the legs are to be elevated above the heart or the heart above the legs. In either position, the extension 29 is located under the patient to immobilize the bolster. In one position, the thighs contact the pad 27 and the other position, the patient's back contacts the pad 27.

A number of embodiments of the present invention have been described. Nevertheless, it will be understood that various modifications may be made without departing from the spirit and scope of the invention. Accordingly, it is to be understood that the invention is not to be limited by the specific illustrated embodiment but only by the scope of the appended claims.

We claim:

1. An adjustable bolster for alleviating the effects of poor circulation comprising an elongated base frame for resting on a supporting surface, a fastener mounted on said base frame, a support frame for contacting a patient rotatably connected to said base frame, a brace pivotally attached to said support frame, said brace adapted to engage said fastener on said base frame whereby the angle between said base frame and said support frame may be temporarily fixed and secured, said bolster further comprising an elongated safety stop rotatably connected to said brace, said safety stop extending in a plane normal to said base frame, whereby said safety stop prevents said base frame and said support frame from coming into contact.

2. An adjustable bolster of claim 1 comprising a material covering said support frame, said material having an extension extending beyond the rotatable connection between said base frame and said support frame, said extension adapted to be placed between a patient and a supporting surface whereby said bolster is held in place.

3. An adjustable bolster of claim 2 comprising said support frame being a U-shaped member, said U-shaped member of said support frame being longer than said base frame, said brace connected to said support frame by a hinge, said hinge located beyond said base member whereby said brace vectors forces toward said extension.

4. An adjustable bolster of claim 1 comprising a U-shaped member with an open end constituting said base frame, said support frame being constructed as a U-shaped member with an open end, said open end of said base frame and said open end of said support frame being rotatably joined by a connector.

5. An adjustable bolster of claim 1 comprising said fastener having an elongated slot extending along the longitudinal axis of said base frame, said slot having a plurality of longitudinally spaced detents normal to said slot, said brace having a pawl sliding in said slot, said pawl adapted to be engaged in a detent thereby fixing and securing the angle between said base frame and said support frame.

6. An adjustable bolster of claim 5 comprising said brace being a U-shaped member with an open end, said brace attached to said support frame by a hinge, said open end including a pawl.

7. An adjustable bolster of claim 1 comprising said brace being a U-shaped member with an open end, said brace attached to said support frame by a hinge, said open end including a pawl.

8. An adjustable bolster of claim 1 comprising said support frame being a U-shaped member, said U-shaped member of said support frame being longer than said base frame, said brace connected to said support frame by a hinge, said hinge located beyond said base member whereby said brace vectors forces toward said rotatable connection.

9. An adjustable bolster for alleviating the effects of poor circulation comprising a U-shaped base frame with an open side terminating in free ends, a U-shaped support frame with an open side terminating in free end, said free ends of said base frame and said free ends of said support frame, respectively, being rotatably connected, said support frame being longer than said base frame and extending beyond said base frame, a U-shaped brace having an open end terminating in free ends attached to said support frame beyond said base frame, at least one adjustable fastener secured to said base frame, said free ends of said brace adapted to cooperate with said at least one adjustable fastener to fix and secure the angle between said base frame and said support frame and vector forces toward said rotatable connection between said free ends of said base frame and said support frame, a flexible material spanning the U-shaped member of said support frame, said flexible material including an extension projecting beyond said rotatably connected free ends whereby said bolster is retained in place during use, said bolster further comprising an elongated safety stop rotatably connected to said brace, said safety stop extending in a plane normal to said base frame, whereby said safety stop prevents said base frame and said support frame from coming into contact.

* * * * *